US011145254B2

(12) United States Patent
Nam

(10) Patent No.: US 11,145,254 B2
(45) Date of Patent: Oct. 12, 2021

(54) PIXEL HAVING REDUCED LUMINANCE CHANGE AND ORGANIC LIGHT EMITTING DISPLAY DEVICE HAVING THE SAME

(71) Applicant: Samsung Display Co., Ltd., Yongin-si (KR)

(72) Inventor: Hui Nam, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/561,637

(22) Filed: Sep. 5, 2019

(65) Prior Publication Data

US 2020/0105192 A1 Apr. 2, 2020

(30) Foreign Application Priority Data

Sep. 28, 2018 (KR) ..... 10-2018-0116640

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2300/0426* (2013.01); *G09G 2300/08* (2013.01); *G09G 2310/08* (2013.01); *G09G 2320/0233* (2013.01)

(58) Field of Classification Search
CPC ..... G09G 3/3233; G09G 3/2007; G09G 2310/08; G09G 2320/045; G09G 2300/08; G09G 2300/0819; G09G 2320/0233; G09G 2300/0861; G09G 2300/0426; G09G 2300/0842
See application file for complete search history.

(56) References Cited

U.S. PATENT DOCUMENTS 9,728,136 B2 * 8/2017 Pyo ..... G09G 3/2022
2016/0043159 A1 * 2/2016 Kim ..... H01L 27/3265 257/71
2016/0322449 A1 * 11/2016 Pyon ..... H01L 27/3262
2017/0076671 A1 * 3/2017 Kim ..... G09G 3/3266
2017/0200742 A1 * 7/2017 Shin ..... H01L 27/127
2017/0249882 A1 * 8/2017 Lee ..... G09G 3/3241

FOREIGN PATENT DOCUMENTS

KR 10-2016-0067636 A 6/2016
KR 10-2017-0031321 A 3/2017
KR 10-2017-0141304 A 12/2017

* cited by examiner

*Primary Examiner* — Kwang-Su Yang
(74) *Attorney, Agent, or Firm* — Lewis Roca Rothgerber Christie LLP

(57) ABSTRACT

An organic light emitting display device includes a display panel and a display driver. Each of the pixels included in the display panel has a first switching element, a second switching element, and a third switching element that are switching elements of a first type, and the fourth switching element that is the switching element of a second type different from the first type.

19 Claims, 11 Drawing Sheets

PIXEL HAVING REDUCED LUMINANCE CHANGE AND ORGANIC LIGHT EMITTING DISPLAY DEVICE HAVING THE SAME

CROSS-REFERENCE TO RELATED APPLICATION(S)

This application claims priority to and the benefit of Korean Patent Application No. 10-2018-0116640, filed on Sep. 28, 2018 in the Korean Intellectual Property Office (KIPO), the contents of which are incorporated herein in their entirety by reference.

BACKGROUND

1. Field

Example embodiments relate generally to a pixel of an organic light emitting display device and an organic light emitting display device having the same.

2. Description of the Related Art

Flat panel display (FPD) devices are widely used as a display device of electronic devices because FPD devices are relatively lightweight and thin compared to cathode-ray tube (CRT) display devices. Examples of FPD devices include liquid crystal display (LCD) devices, field emission display (FED) devices, plasma display panel (PDP) devices, and organic light emitting display (OLED) devices. The OLED display devices have been spotlighted as next-generation display devices because OLED display devices have various features, such as a wide viewing angle, a rapid response speed, a thin thickness, low power consumption, etc.

Low frequency driving methods may be used in order to decrease the power consumption of OLED display devices. When an OLED device is driven in the low frequency driving method, a leakage current that flows through a switching transistor coupled to a driving transistor in the pixel may occur. The leakage current may result in a decrease in the brightness of the pixel.

SUMMARY

Some example embodiments provide a pixel of an organic light emitting display device capable of improving display quality.

Some example embodiments provide an organic light emitting display device capable of improving display quality.

According to an aspect of example embodiments, an organic light emitting display device may include a display panel including a plurality of pixels and a panel driver configured to provide a first scan signal, a second scan signal, a data voltage, a initialization voltage, a first power voltage, and a second power voltage to the pixels. Each of the pixels may include a first switching element having a gate electrode coupled to a first node, a first electrode coupled to a second node, and a second electrode coupled to a third node, a second switching element having a gate electrode to receive the first scan signal, a first electrode to receive the data voltage, and a second electrode coupled to the second node, a third switching element having a gate electrode to receive the first scan signal, a first electrode coupled to the first node, and a second electrode coupled to the third node, a fourth switching element having a gate electrode to receive the second scan signal, a first electrode coupled to the first node, and a second electrode to receive the initialization voltage, a storage capacitor having a first electrode to receive the first power voltage and a second electrode coupled to the first node, and an organic light emitting diode having a first electrode to receive a driving current generated in the first switching element and a second electrode to receive the second power voltage. The first switching element, the second switching element, and the third switching element may be switching elements of a first type, and the fourth switching element may be a switching element of a second type different from the first type.

In example embodiments, the switching element of the first type may be a P-channel metal oxide semiconductor (PMOS) transistor, and the switching element of the second type may be an N-channel metal oxide semiconductor (NMOS) transistor.

In example embodiments, the switching element of the first type may be an N-channel metal oxide semiconductor (NMOS) transistor, and the switching element of the second type may be a P-channel metal oxide semiconductor (PMOS) transistor.

In example embodiments, the panel driver may drive the display panel in a frame that includes a first period during which a gate voltage of the gate electrode of the first switching element is initialized with the initialization voltage, a second period during which the data voltage is written, and a third period during which the organic light emitting diode emits light.

In example embodiments, the second scan signal having a turn-on level may be provided during the first period, the first scan signal having the turn-on level may be provided during the second period, an emission control signal having the turn-on level may be provided during the third period.

In example embodiments, the third switching element and the fourth switching element may be dual gate transistors.

In example embodiments, the fourth switching element may be a single gate transistor.

According to an aspect of example embodiments, a pixel of an organic light emitting display device may include a first switching element having a gate electrode coupled to a first node, a first electrode coupled to a second node, and a second electrode coupled to a third node, a second switching element having a gate electrode to receive a first scan signal, a first electrode to receive a data voltage, and a second electrode coupled to the second node, a third switching element having a gate electrode to receive the first scan signal, a first electrode coupled to the first node, and a second electrode coupled to the third node, a fourth switching element having a gate electrode to receive a second scan signal, a first electrode coupled to the first node, and a second electrode to receive an initialization voltage, a storage capacitor having a first electrode to receive a first power voltage and a second electrode coupled to the first node, and an organic light emitting diode having a first electrode to receive a driving current generated in the first switching element and a second electrode to receive a second power voltage. The first switching element, the second switching element, and the third switching element may be switching elements of a first type, and the fourth switching element may be a switching element of a second type different from the first type.

In example embodiments, the switching element of the first type may be a P-channel metal oxide semiconductor (PMOS) transistor, and the switching element of the second type may be an N-channel metal oxide semiconductor (NMOS) transistor.

In example embodiments, the switching element of the first type may be an N-channel metal oxide semiconductor (NMOS) transistor, and the switching element of the second type may be a P-channel metal oxide semiconductor (PMOS) transistor.

In example embodiments, the third switching element and the fourth switching element may be dual gate transistors.

In example embodiments, the fourth switching element may be a single gate transistor.

According to an aspect of example embodiments, an organic light emitting display device may include a display panel including a plurality of pixels, a data driver configured to generate a data voltage provided to the pixels, a scan driver configured to generate a first scan signal and a second scan signal provided to the pixels, an emission controller configured to generate an emission control signal provided to the pixels, and a timing controller configured to generate control signals that control the data driver, the scan driver, and the emission controller. The timing controller may receive image data displayed on the display panel and output a first level control signal that controls a voltage level of the first scan signal and a second level control signal that controls a voltage level of the second scan signal based on grayscale values of the image data.

In example embodiments, the timing controller may generate the first level control signal and the second level control signal based on an average value of the grayscale values of the image data.

In example embodiments, the timing controller may generate the first level control signal and the second level control signal based on an average value of the grayscale values of the image data per frame.

In example embodiments, the timing controller may generate the first level control and the second level control signal based on an average value of the grayscale value of the image data provided to one of pixel lines.

In example embodiments, each of the pixels may include a first switching element having a gate electrode coupled to a first node, a first electrode coupled to a second node, and a second electrode coupled to a third node, a second switching element having a gate electrode to receive the first scan signal, a first electrode to receive a data voltage, and a second electrode coupled to the second node, a third switching element having a gate electrode to receive the first scan signal, a first electrode coupled to the first node, and a second electrode coupled to the third node, a fourth switching element having a gate electrode to receive the second scan signal, a first electrode coupled to the first node, and a second electrode coupled to a fourth node, a fifth switching element having a gate electrode to receive the emission control signal, a first electrode to receive a first power voltage, and a second electrode coupled to the second node, a sixth switching element having a gate electrode to receive the emission control signal, a first electrode coupled to the third node, and a second electrode coupled to a fifth node, a seventh switching element having a gate electrode to receive the first scan signal, a first electrode coupled to the fourth node, and a second electrode coupled to the fifth node, a storage capacitor having a first electrode to receive a first power voltage and a second electrode coupled to the first node, an organic light emitting diode having a first electrode coupled to the fifth node and a second electrode to receive a second power voltage.

In example embodiments, the first switching element, the second switching element, the third switching element, the fourth switching element, the fifth switching element, the sixth switching element, and the seventh switching element may be P-channel metal oxide semiconductor (PMOS) transistors.

In example embodiments, the scan driver may be configured to change a high level voltage of the first scan signal based on the first level control signal and be configured to change a high level voltage of the second scan signal based on the second level control signal.

In example embodiments, the timing controller may include a first lookup table (LUT) that stores the first level control signal corresponding to an average value of the grayscale values of the image data and a second lookup table that stores the second control signal corresponding to an average value of the grayscale values of the image data.

Therefore, the pixel of the organic light emitting display device and the organic light emitting display device having the same may decrease a changing of a voltage level of the gate electrode of the first switching element by including the third switching element that is the switching element of the first type and the fourth switching element that is the switching element of the second type.

Further, the organic light emitting display device may decrease the changing of the voltage level of the gate electrode of the first switching element by controlling the voltage level of the first scan signal and the second scan signal based on the grayscale values of the image data.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
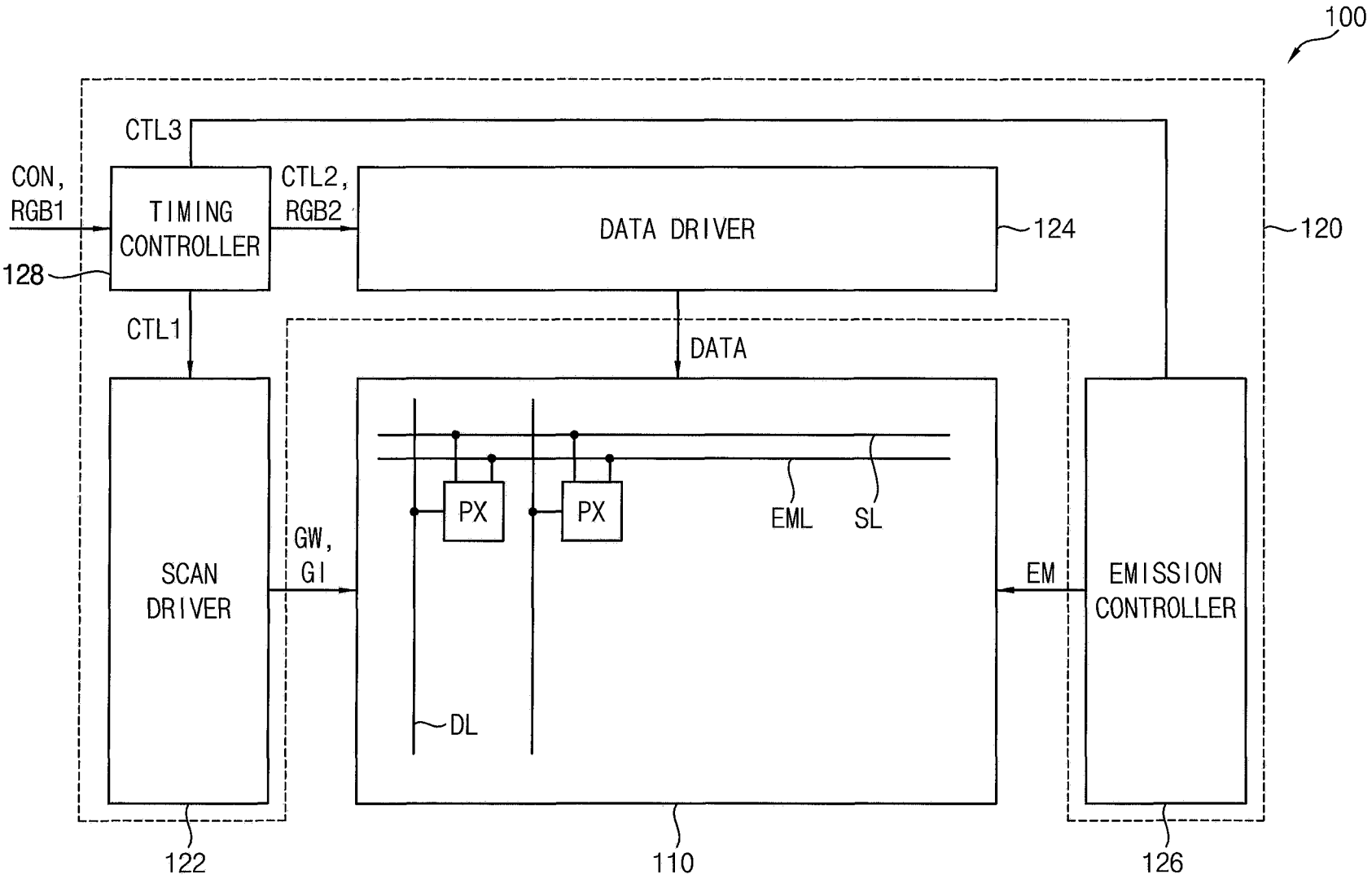
FIG. 1 is a block diagram illustrating an organic light emitting display device according to example embodiments.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The pixels, display device, or display devices and/or any other relevant devices or components, such as, for example, a panel driver, a data driver, a scan driver, an emission controller, and a timing controller, according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, the present inventive concept will be explained in detail with reference to the accompanying drawings.

Figure 2A:
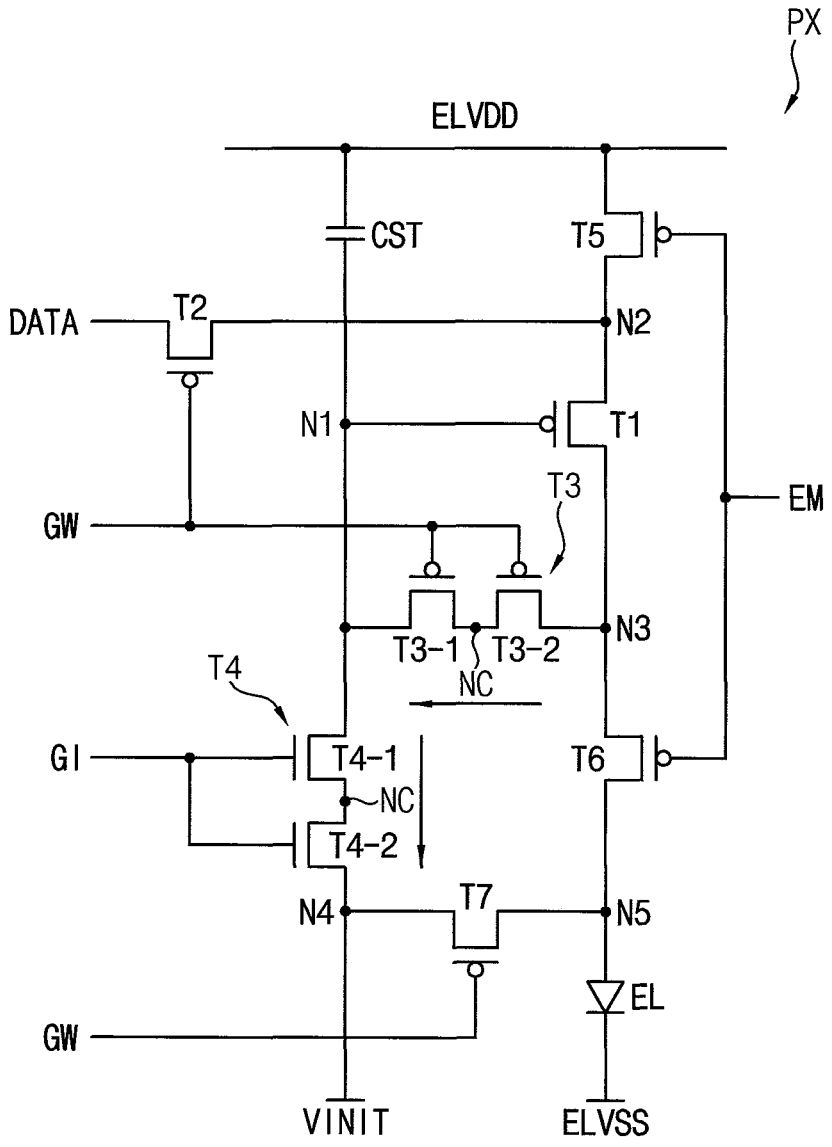
FIG. 2A is a circuit diagram illustrating an example of a pixel included in the organic light emitting display device of FIG. 1.
Figure 2B:
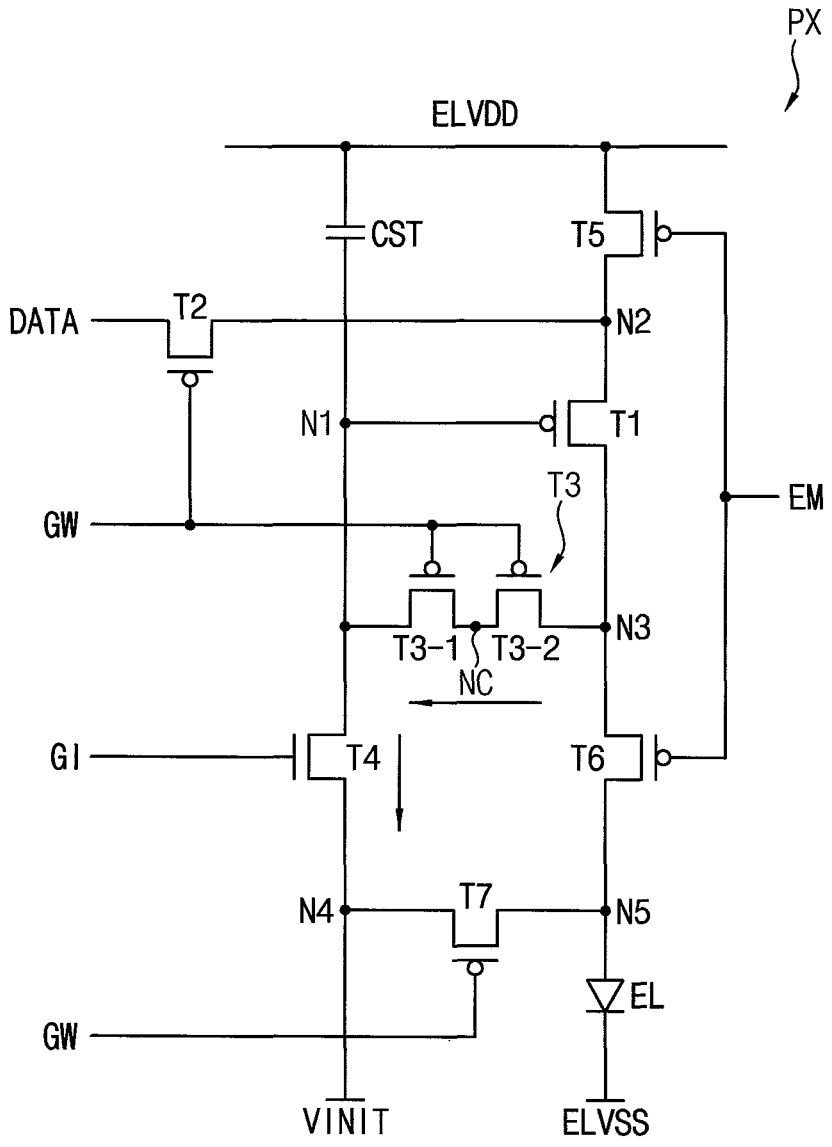
FIG. 2B is a circuit diagram illustrating other example of a pixel included in the organic light emitting display device of FIG. 1.

FIG. 1 is a block diagram illustrating an organic light emitting display device according to example embodiments. FIG. 2A is a circuit diagram illustrating an example of a pixel included in the organic light emitting display device of FIG. 1. FIG. 2B is a circuit diagram illustrating another example of a pixel included in the organic light emitting display device of FIG. 1.

Referring to FIG. 1, an organic light emitting display device 100 according to an example embodiment may include a display panel 110 and a panel driver 120. In some example embodiments, the panel driver 120 may include a data driver 124, a scan driver 122, an emission controller 126, and a timing controller 128.

The display panel 110 may include a plurality of pixels PX. A plurality of data lines DL, a plurality of scan lines SL, and a plurality of emission control lines EML may be formed on the display panel 110. The plurality of pixels PX may be formed at crossing regions of the data lines DL and the scan lines SL.

Referring to FIGS. 2A and 2B, the pixel PX may include a first switching element T1, a second switching element T2, a third switching element T3, a fourth switching element T4, a storage capacitor CST, and an organic light emitting diode EL. The pixel PX may further include a fifth switching element T5, a sixth switching element T6, and a seventh switching element T7. The first switching element T1, the second switching element T2, the third switching element T3, the fifth switching element T5, the sixth switching element T6, and the seventh switching element T7 may be switching elements of a first type. The fourth switching element T4 may be a switching element of a second type. In some example embodiments, the switching elements of the first type may be P-channel metal oxide semiconductor (PMOS) transistors, and the switching elements of the second type may be N-channel metal oxide semiconductor (NMOS) transistors. The PMOS transistor may be turned on in response to a signal having a low level, and the NMOS transistor may be turned on in response to a signal having a high level. Referring to FIG. 2A, the third switching element T3 and the fourth switching element T4 may each be a dual gate transistor or multiple transistors (e.g., switching elements T3-1 and T3-2, and T4-1 and T4-2). Referring to FIG. 2B, the fourth switching element T4 may be a single gate transistor.

The first switching element T1 may have a gate electrode coupled to a first node N1, a first electrode coupled to a second node N2, and a second electrode coupled to a third node N3. For example, the first electrode of the first switching element T1 may be a source electrode and the second electrode of the first switching element T1 may be a drain electrode. The first switching element T1 may be a driving transistor that generates a driving current.

The second switching element T2 may have a gate electrode to receive a first scan signal GW, a first electrode that receives a data voltage DATA, and a second electrode coupled to the second node N2. For example, the first electrode of the second switching element T2 may be a source electrode and the second electrode of the second switching element T2 may be a drain electrode. The second switching element T2 may turn on in response to the first scan signal GW having the low level. When the second switching element T2 turns on, the data voltage DATA provided through the data line DL may be provided to the second node N2 through the second switching element T2.

The third switching element T3 may have a gate electrode that receives the first scan signal GW, a first electrode coupled to the first node N1, and a second electrode coupled to the third node N3. For example, the first electrode of the third switching element T3 may be a source electrode and the second electrode of the third switching element T3 may be a drain electrode. The third switching element T3 may turn on in response to the first scan signal GW having the low level. When the third switching element T3 turns on, the third node N3 and the first node N1 may be coupled. The third switching element T3 may be the dual gate transistor that includes two switching elements T3-1, T3-2. The two switching elements T3-1, T3-2 may be serially coupled. Further, the gate electrodes of the switching elements T3-1, T3-2 may be coupled.

The fourth switching element T4 may have a gate electrode that receives the second scan signal GI, a first electrode coupled to the first node N1, and a second electrode coupled to a fourth node N4. For example, the first electrode of the fourth switching element T4 may be a source electrode and the second electrode of the fourth switching element T4 may be a drain electrode. The fourth switching element T4 may turn on in response to the second scan signal GI having the high level. When the fourth switching element T4 turns on, the first node N1 and the fourth node N4 may be coupled. The fourth switching element T4 may be the dual gate transistor that includes two switching elements T4-1, T4-2 as shown in FIG. 2A. The two switching elements T4-1, T4-2 may be serially coupled. Further, the gate electrodes of the switching elements T4-1, T4-2 may be coupled. The fourth switching element T4 may be the single gate transistor as shown in FIG. 2A.

The fifth switching element T5 may have a gate electrode that receives an emission control signal EM, a first electrode that receives a first power voltage ELVDD, and a second electrode coupled to the second node N2. For example, the first electrode of the fifth switching element T5 may be a source electrode and the second electrode of the fifth switching element T5 may be a drain electrode. The fifth switching element T5 may turn on in response to the emission control signal EM having the low level. When the fifth switching element T5 turns on, the first power voltage ELVDD provided through a first power voltage providing line may be provided to the second node N2.

The sixth switching element T6 may have a gate electrode that receives the emission control signal EM, a first electrode coupled to the third node N3, and a second electrode coupled to the fifth node N5. For example, the first electrode of the sixth switching element T6 may be a source electrode and the second electrode of the sixth switching element T6 may be a drain electrode. The sixth switching element T may turn on in response to the emission control signal EM having the low level. When the sixth switching element T6 turns on, the third node N3 and the fifth node N5 may be coupled.

The storage capacitor CST may have a first electrode that receives the first power voltage ELVDD and a second electrode coupled to the first node N1. The data voltage DATA may be written in the storage capacitor CST.

The organic light emitting diode EL may have a first electrode coupled to the fifth node N5 and a second electrode that receives the second power voltage ELVSS. For example, the first electrode may be an anode electrode and the second electrode may be a cathode electrode.

When the second scan signal GI is changed from the high level to the low level, a voltage of the first node may decrease because of a coupling phenomenon due to parasitic capacitance (or a parasitic capacitor). Further, when the first scan signal GW is changed from the low level to the high level, the voltage of the first node N1 may increase because of the coupling phenomenon due to the parasitic capacitance. Thus, voltage drop and voltage rise of the first node N1 may be offset. Therefore, a voltage change of the first node N1 (i.e., the gate electrode of the first switching element) may decrease.

The timing controller 128 may receive a first image data RGB1 and an input control signal CON from an external device. For example, the first image data RGB1 may include red color image data, green color image data, and blue color image data. Further, the first image data RGB1 may include magenta color image data, yellow color image data, and cyan color image data. The input control signal CON may include a master clock signal, a data enable signal, a vertical synchronization signal, a horizontal synchronization signal, etc. The timing controller 128 may generate second image data RGB2 based on the first image data RGB1. For example, the timing controller 128 may convert the first image data RGB1 to the second image data RGB2 by applying an algorithm that compensates display quality of the first image data RGB1. The timing controller 128 may output the second image data RGB2 to the data driver 124.

The timing controller 128 may generate a first control signal CTL1, a second control signal CTL2, and a third control signal CTL3 that control the scan driver 122, the data driver 124, and the emission controller 126 based on the first image data RGB1 and the input control signal CON. The timing controller 128 may generate the first control signal CTL1 based on the input control signal CON in order to control an operation of the scan driver 122. The timing controller 128 may output the first control signal CTL1 to the scan driver 122. For example, the first control signal CTL1 may include a vertical start signal and a scan clock signal. The timing controller 128 may generate the second control signal CTL2 based on the input control signal CON in order to control an operation of the data driver 124. The timing controller 128 may output the second control signal CTL2 to the data driver 124. For example, the second control signal CTL2 may include a horizontal start signal and a load signal. The timing controller 128 generate the third control signal CTL3 based on the input control signal CON in order to control an operation of the emission controller 126. The timing controller 128 may output the third control signal CTL3 to the emission controller 126.

The scan driver 122 may generate the first scan signal GW and the second scan signal GI in response to the first control signal CTL1. The scan driver 122 may output the first scan signal GW and the second scan signal GI to the scan lines SL.

The data driver 124 may generate the data voltage DATA based on the second image data RGB2 and the second control signal CTL2. The data driver 124 may generate gamma reference voltages based on the second control signal CTL2 and an analog driving voltage. The gamma reference voltage may have a voltage level corresponding to the second image data RGB2. For example, the data driver 124 may generate the gamma reference voltage by dividing the analog driving voltage. The data driver 124 may convert the second image data RGB2 to the data voltage DATA that is an analog signal using the gamma reference voltage. The data driver 124 may output the data voltage DATA to the data lines DL.

The emission controller 126 may generate the emission control signal EM in response to the third control signal CTL3. The emission controller 126 may output the emission control signal EM to the emission control lines EML.

Figure 3:
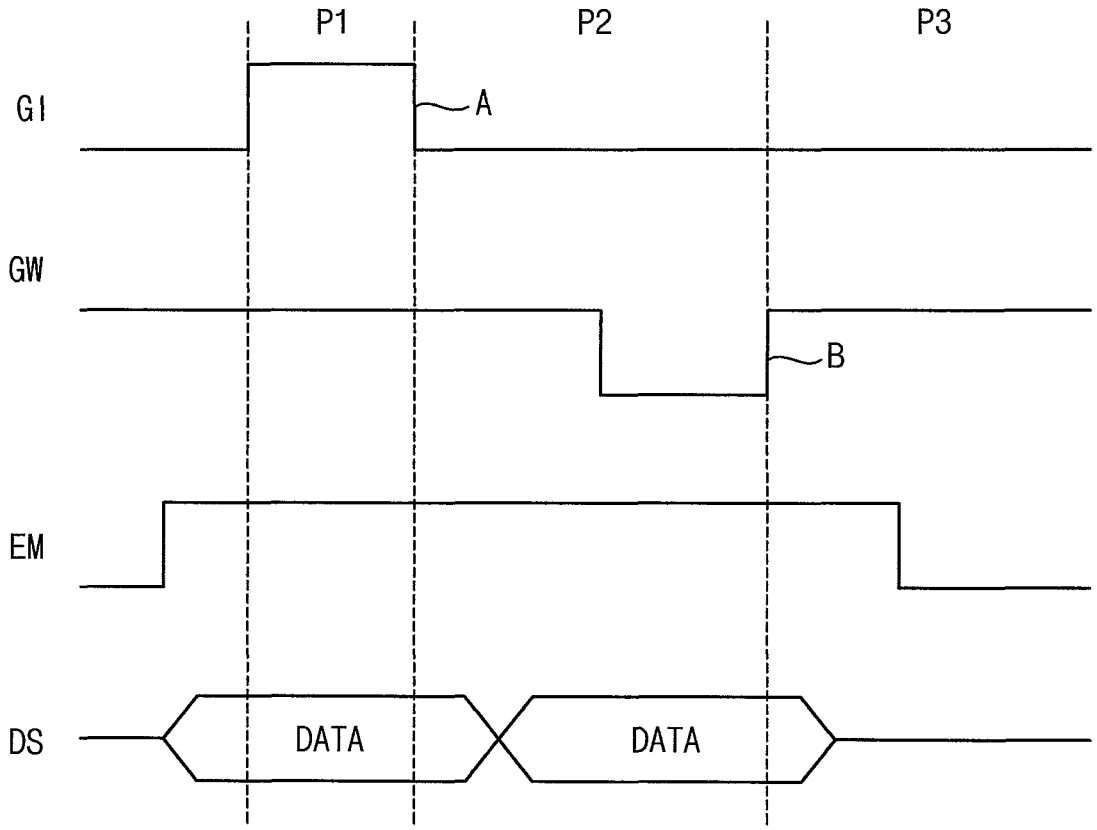
FIG. 3 is a timing diagram illustrating an operation of the pixel of FIG. 2A.
Figure 4A:
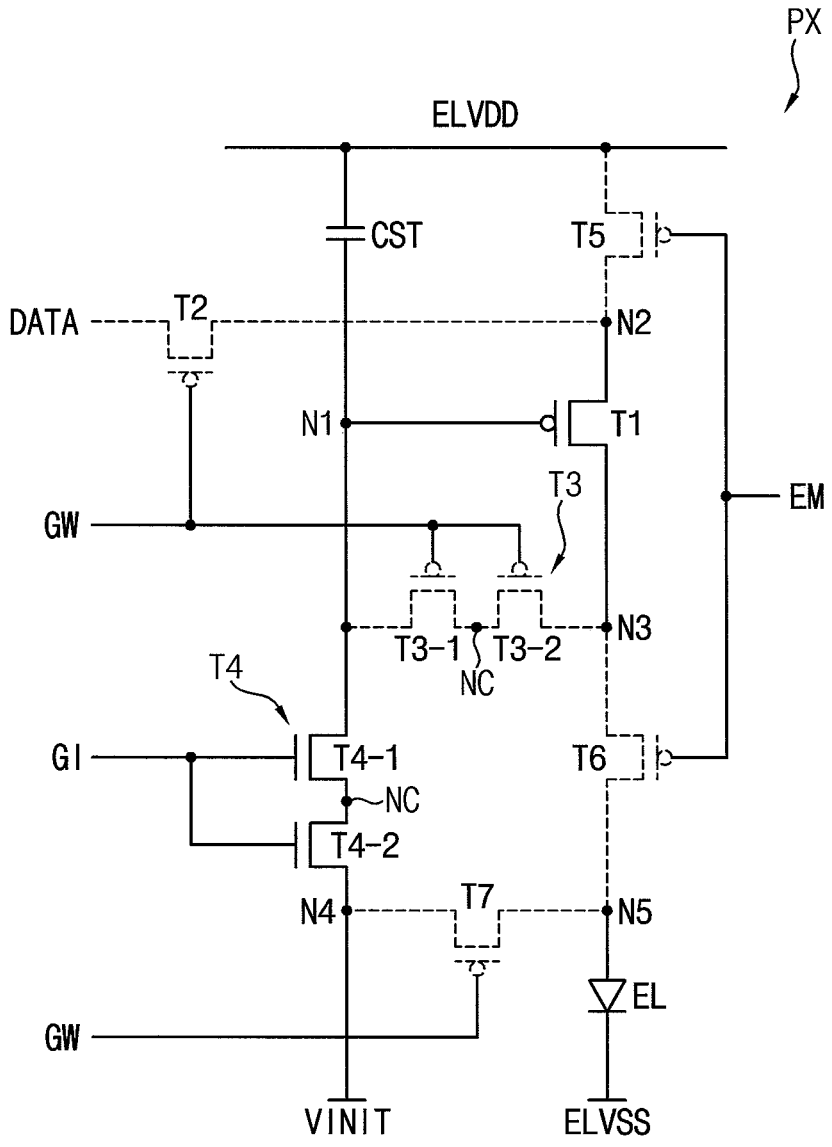
FIGS. 4A-4C are circuit diagrams illustrating an operation of the pixel of FIG. 2A.
Figure 4B:
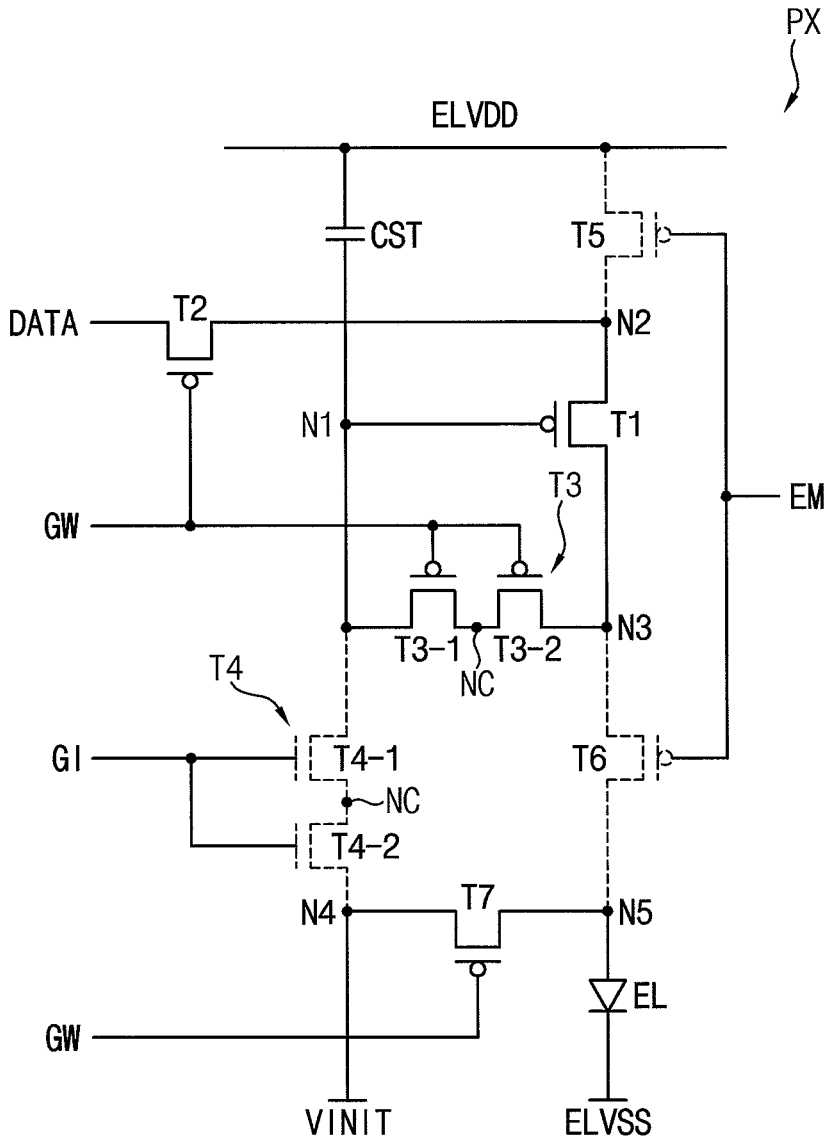
Figure 4C:
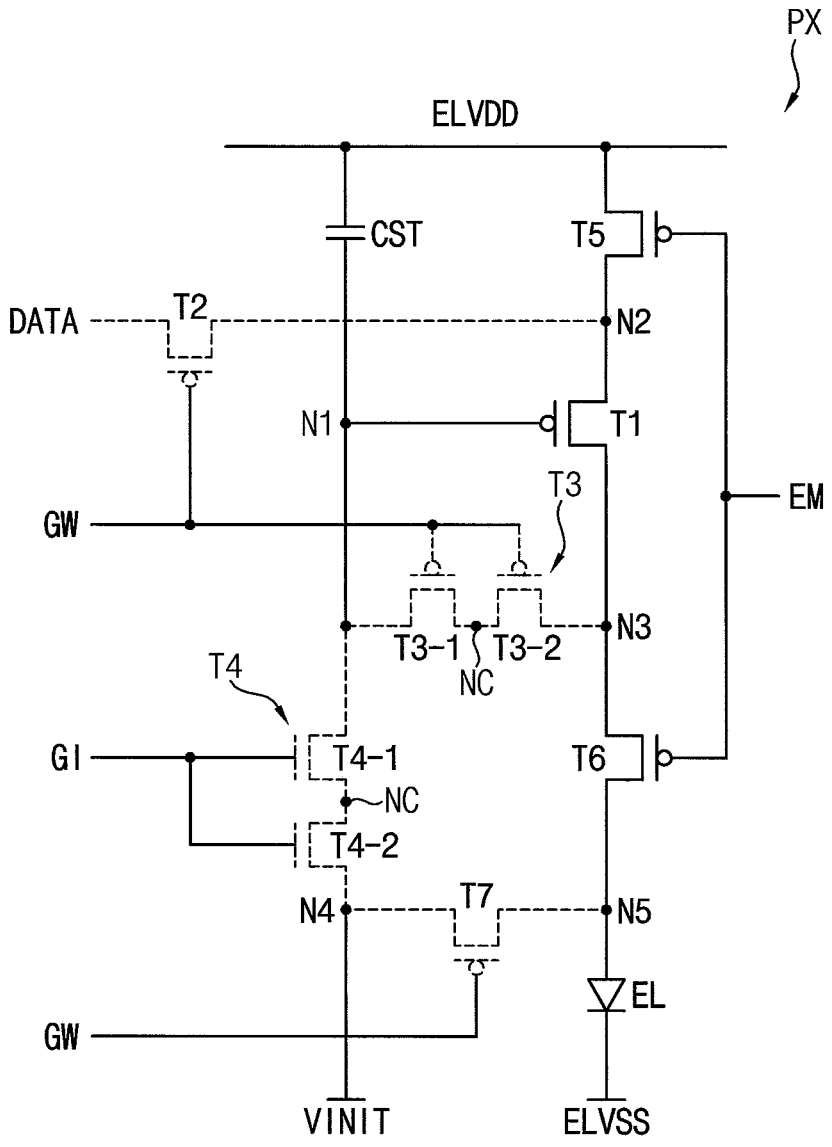

FIG. 3 is a timing diagram illustrating an operation of the pixel of FIG. 2A. FIGS. 4A through 4C are circuit diagrams illustrating an operation of the pixel of FIG. 2A.

Referring to FIG. 3, the panel driver 120 of the organic light emitting display device 100 may drive the display panel 110 in frames that include a first period P1, a second period P2, and a third period P3.

Referring to FIGS. 3 and 4A, the first scan signal GW having the high level, the second scan signal GI having the high level, and an emission control signal EM having the high level may be provided to the pixel PX during the first period P1. The second switching element T2, the third switching element T3, and the seventh switching element T7 may turn off in response to the first scan signal GW having the high level. The fourth switching element T4 may turn on in response to the second scan signal GI having the high level. The first node N1 and the fourth node N4 may be coupled in the first period P1 because the fourth switching element T4 turns on. The initialization voltage VINIT may be provided to the first node N1 (i.e., the gate electrode of the first switching element T1) through the fourth switching element T4. The first node N1 may be initialized with the initialization voltage VINIT. The fifth switching element T5 and the sixth switching element T6 may turn off in response to the emission control signal EM having the high level.

Referring to FIGS. 3 and 4B, the first scan signal GW having the low level, the second scan signal GI having the low level, and the emission control signal having the high level may be provided to the pixel PX during a portion of the second period P2. The second switching element T2, the third switching element T3, and the seventh switching element T7 may turn on in response to the first scan signal GW having the low level. The data voltage DATA may be provided to the second node N2 in the second period P2 because the second switching element T2 turns on. The third node N3 and the first node N1 may be coupled and the first switching element T1 may be diode-connected in the second period P2 because the third switching element T3 turns on. Thus, the data voltage DATA in which a threshold voltage of the first switching element T1 is compensated may be stored in the storage capacitor CST. The fourth node N4 and the fifth node N5 may be coupled in the second period P2 because the seventh switching element T7 turns on. The initialization voltage VINT may be provided to the fifth node N5 (i.e., the first electrode of the organic light emitting diode EL) through the seventh switching element T7. The fifth node N5 may be initialized with the initialization voltage VINIT. The fourth switching element T4 may turn off in response to the second scan signal GI having the low level and a connection node NC at which two switching elements T4-1, T4-2 are connected may be floating. When the second scan signal GI having the high level in the first period P1 is changed to the low level in the second period P2 (A), the first node N1 may be coupling with the second scan signal GI due to the parasitic capacitance. Thus, the voltage level of the first node N1 may decrease. That is, the voltage level of the gate electrode of the first switching element T1 may decrease less than a voltage level of the initialization voltage VINIT because of leakage current occurring in the fourth switching element T4. The fifth switching element T5 and the sixth switching element T6 may turn off in response to the emission control signal EM having the high level.

Referring to FIGS. 3 and 4C, the first scan signal GW having the high level, the second scan signal GI having the low level, and the emission control signal EM having the low level may be provided to the pixel PX during the third period P3. The second switching element T2, the third switching element T3, and the seventh switching element T7 may turn off in response to the first scan signal GW having the high level. Here, a connection node NC at which two switching elements T3-1, T3-2 are connected may be floating. When the first scan signal GW having the low level in the second period P2 is changed to the high level in the third period P3 (B), the first node N1 may be coupling with the first scan signal GW due to the parasitic capacitance. Thus, the voltage level of the first node N1 may increase. That is, the voltage level of the gate electrode of the first switching element T1 may increase because of leakage current occurred in the third switching element T3. Thus, the voltage level of the first node N1 may be uniformly maintained because the voltage of the first node N1 decreased in the second period P2 increases in the third period P3. The fourth switching element T4 may turn off in response to the second scan signal GI having the low level. The fifth switching element T5 and the sixth switching element T6 may turn on in response to the emission control signal EM having the low level. The first power voltage ELVDD may be provided to the second node N2 because the fifth switching element T5 turns on. The first switching element T1 may generate the driving current corresponding to the voltage of the gate electrode (i.e., the first node N1). The third node N3 and the fifth node N5 may be coupled because the sixth switching element T6 turns on. The organic light emitting diode EL may emit light based on the driving current generated in the first switching element T1.

As described above, the pixel PX may include the third switching element T3 and the fourth switching element T4 coupled to the gate electrode of the first switching element T1. Here, the third switching element T3 may be implemented as a PMOS transistor and the fourth switching element T4 may be implemented as a NMOS transistor. Thus, a direction of the leakage current occurred by the coupling phenomenon may be opposite. That is, the gate electrode of the first switching element T1 may be coupling with the second scan signal GI and the voltage level of the gate electrode of the first switching element T1 may decrease because of the floating of the connection node NC of the fourth switching element T4 that is the NMOS transistor. Further, the gate electrode of the first switching element T1 may be coupling with the first GW and the voltage level of the gate electrode of the first switching element T1 may increase because of the floating of the connection node NC of the third switching element T3. Thus, the change of the voltage level of the gate electrode of the first switching element T1 may be offset. Therefore, change of luminance of the pixel may decrease.

Figure 5:
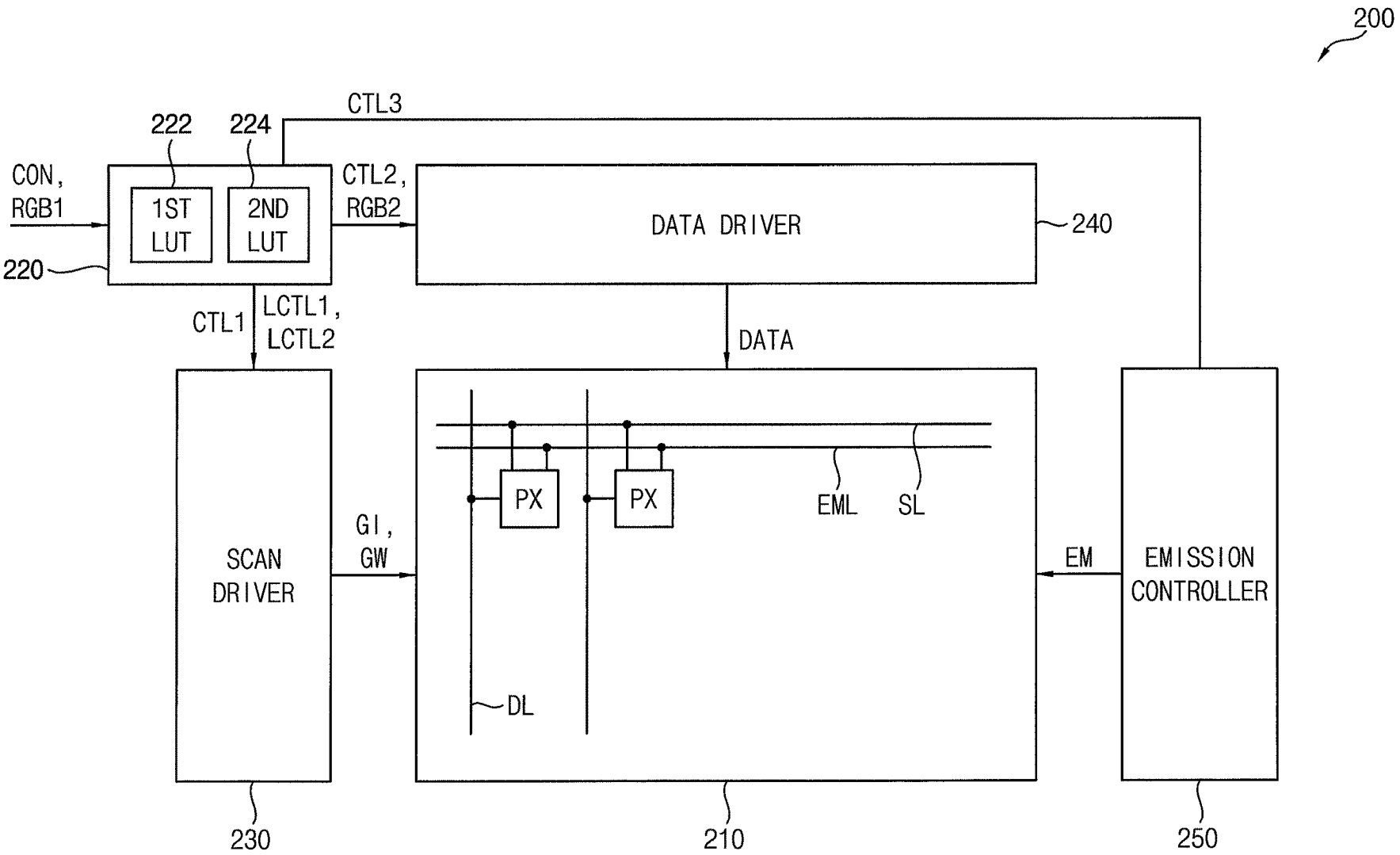
FIG. 5 is a block diagram illustrating an organic light emitting display device according to example embodiments.
Figure 6A:
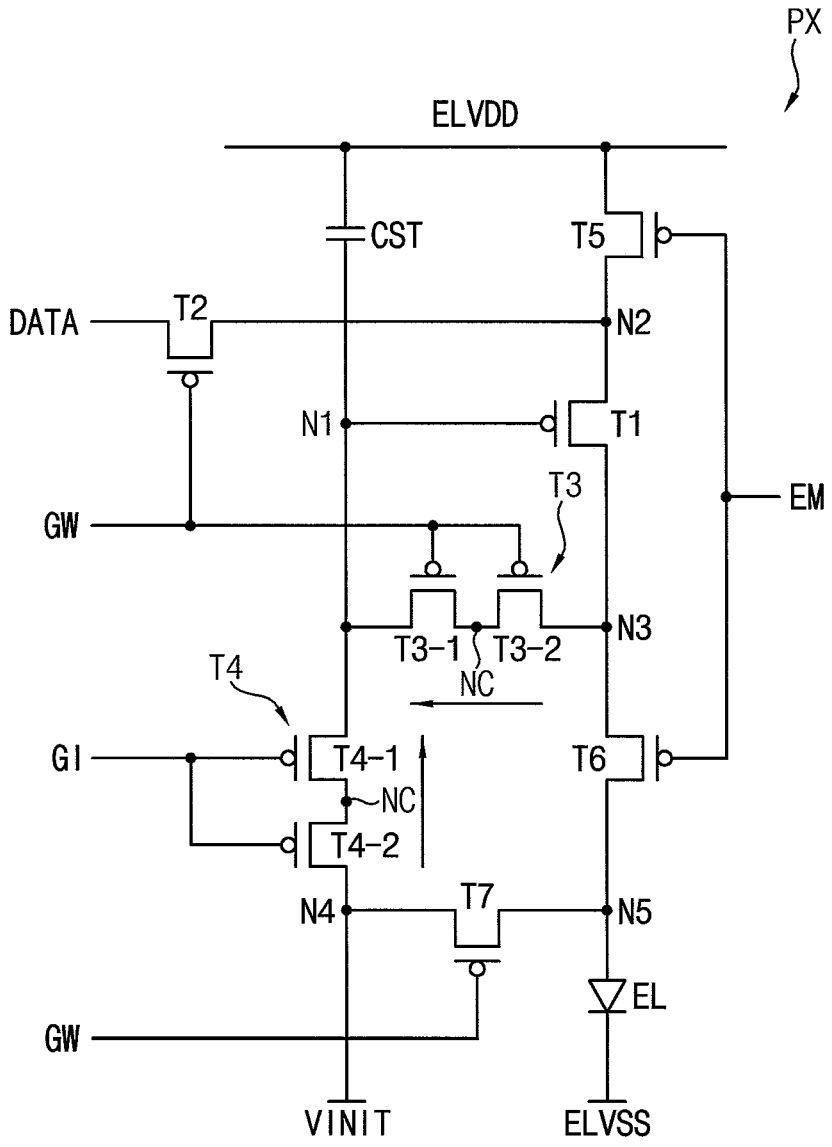
FIG. 6A is a circuit diagram illustrating a pixel included in the organic light emitting display device of FIG. 5.
Figure 6B:
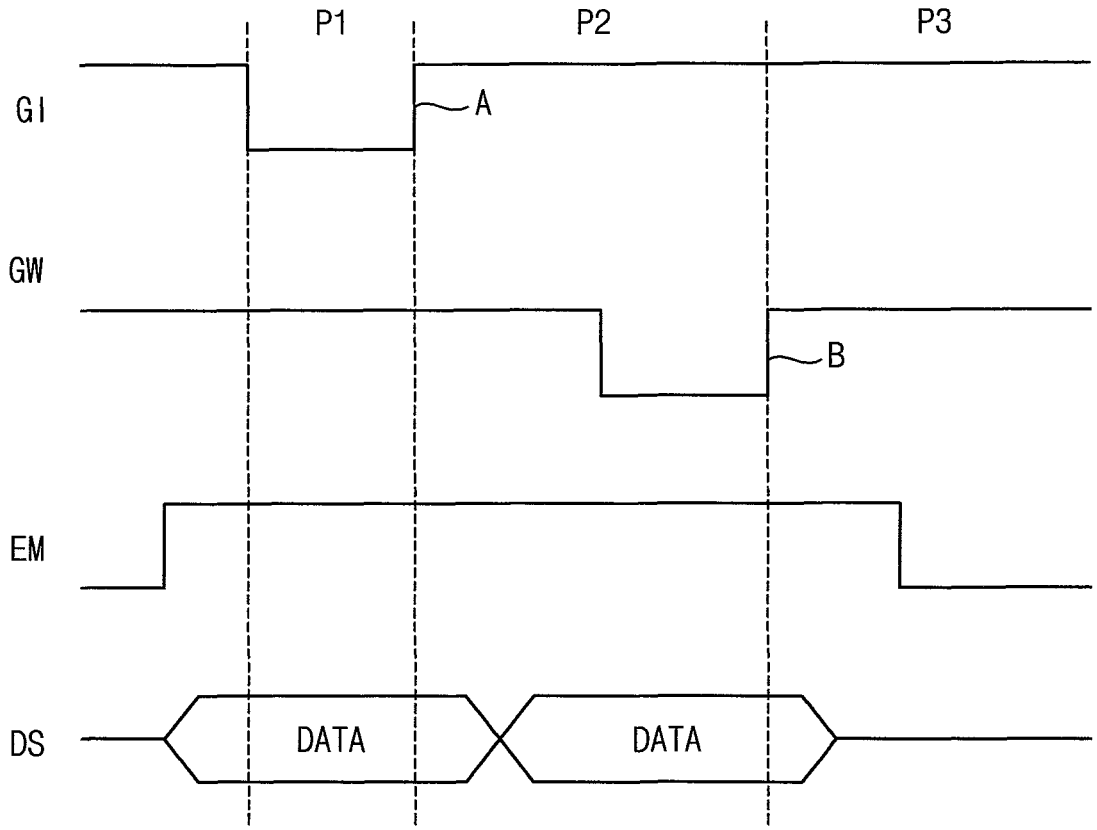
FIG. 6B is a timing diagram illustrating an operation of the pixel of FIG. 6A.
Figure 7:
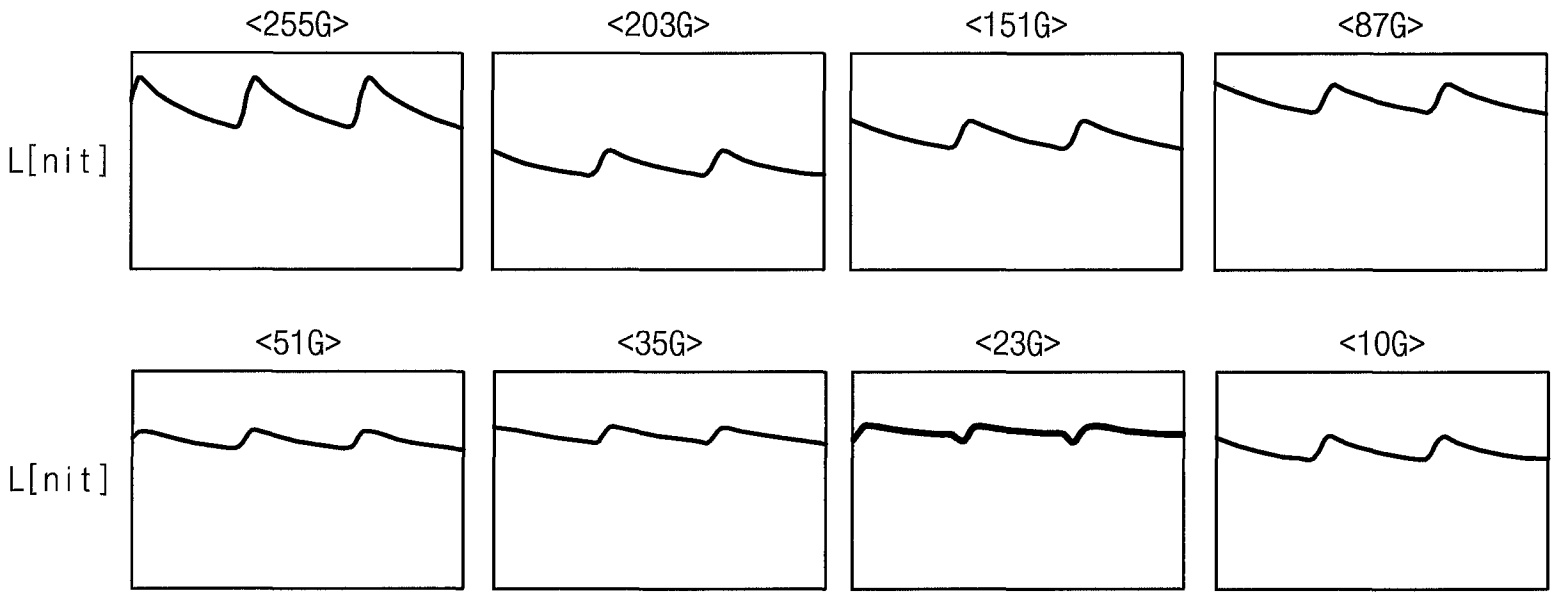
FIG. 7 is a diagram illustrating an operation of the organic light emitting display device.

FIG. 5 is a block diagram illustrating an organic light emitting display device according to example embodiments. FIG. 6A is a circuit diagram illustrating a pixel included in the organic light emitting display device of FIG. 5. FIG. 6B is a timing diagram illustrating an operation of the pixel of FIG. 6A. FIG. 7 is a diagram illustrating an operation of the organic light emitting display device.

Referring to FIG. 5, an organic light emitting display device 200 may include a display panel 210, a timing controller 220, a scan driver 230, a data driver 240, and an emission controller 250.

The display panel 210 may include a plurality of pixels PX. A plurality of data lines DL, a plurality of scan lines SL, and a plurality of emission control lines EML may be formed on the display panel 210. The plurality of pixels PX may be formed at crossing regions of the data lines DL and the scan lines SL.

Referring to FIG. 6A, the pixel PX may include a first switching element T1, a second switching element T2, a third switching element T3, a fourth switching element T4, a fifth switching element T5, a sixth switching element T6, a seventh switching element T7, a storage capacitor CST, and an organic light emitting diode EL. In some example embodiments, the first switching element T1, the second switching element T2, the third switching element T3, the fourth switching element T4, the fifth switching element T5, the sixth switching element T6, and the seventh switching element T7 may be P-channel metal oxide semiconductor (PMOS) transistors. In other example embodiments, the first switching element T1, the second switching element T2, the third switching element T3, the fourth switching element T4, the fifth switching element T5, the sixth switching element T6, and the seventh switching element T7 may be N-channel metal oxide semiconductor (NMOS) transistors. The first through seventh switching transistors T1 through T7 of FIG. 6A may be implemented as PMOS transistors and may be turned on in response to a signal having a low level. The third switching element T3 and the fourth switching element T4 may be dual gate transistors.

The first switching element T1 may have a gate electrode coupled to a first node N1, a first electrode coupled to a second node N2, and a second electrode coupled to a third node N3. For example, the first electrode of the first switching element T1 may be a source electrode and the second electrode of the first switching element T1 may be a drain electrode. The first switching element T1 may be a driving transistor that generates a driving current.

The second switching element T2 may have a gate electrode that receives a first scan signal GW, a first electrode that receives a data voltage DATA, and a second electrode coupled to the second node N2. For example, the first electrode of the second switching element T2 may be a source electrode and the second electrode of the second switching element T2 may be a drain electrode. The second switching element T2 may turn on in response to the first scan signal GW having the low level. When the second switching element T2 turns on, the data voltage DATA provided through the data line DL may be provided to the second node N2 through the second switching element T2.

The third switching element T3 may have a gate electrode that receives the first scan signal GW, a first electrode coupled to the first node N1, and a second electrode coupled to the third node N3. For example, the first electrode of the third switching element T3 may be a source electrode and the second electrode of the third switching element T3 may be a drain electrode. The third switching element T3 may turn on in response to the first scan signal GW having the low level. When the third switching element T3 turns on, the third node N3 and the first node N1 may be coupled. The third switching element T3 may be the dual gate transistor that includes two switching elements T3-1, T3-2. The two switching elements T3-1, T3-2 may be serially coupled. Further, the gate electrodes of the switching elements T3-1, T3-2 may be coupled.

The fourth switching element T4 may have a gate electrode that receives the second scan signal GI, a first electrode coupled to the first node N1, and a second electrode coupled to a fourth node N4. For example, the first electrode of the fourth switching element T4 may be a source electrode and the second electrode of the fourth switching element T4 may be a drain electrode. The fourth switching element T4 may turn on in response to the second scan signal GI having the low level. When the fourth switching element T4 turns on, the first node N1 and the fourth node N4 may be coupled.

In some example embodiments, the fourth switching element T4 may be a dual gate transistor that includes two switching elements T4-1, T4-2. The two switching elements T4-1, T4-2 may be serially coupled. Further, the gate electrodes of the switching elements T4-1, T4-2 may be coupled. In other example embodiments, the fourth switching element T4 may be a single gate transistor.

The fifth switching element T5 may have a gate electrode that receives an emission control signal EM, a first electrode that receives a first power voltage ELVDD, and a second electrode coupled to the second node N2. For example, the first electrode of the fifth switching element T5 may be a source electrode and the second electrode of the fifth switching element T5 may be a drain electrode. The fifth switching element T5 may turn on in response to the emission control signal EM having the low level. When the fifth switching element T5 turns on, the first power voltage ELVDD provided through a first power voltage providing line may be provided to the second node N2.

The sixth switching element T6 may have a gate electrode that receives the emission control signal EM, a first electrode coupled to the third node N3, and a second electrode coupled to the fifth node N5. For example, the first electrode of the sixth switching element T6 may be a source electrode and the second electrode of the sixth switching element T6 may be a drain electrode. The sixth switching element T may turn on in response to the emission control signal EM having the low level. When the sixth switching element T6 turns on, the third node N3 and the fifth node N5 may be coupled.

The storage capacitor CST may have a first electrode that receives the first power voltage ELVDD and a second electrode coupled to the first node N1. The data voltage DATA may be written in the storage capacitor CST.

The organic light emitting diode EL may have a first electrode coupled to the fifth node N5 and a second electrode that receives the second power voltage ELVSS. For example, the first electrode may be an anode electrode and the second electrode may be a cathode electrode.

Referring to FIG. 6B, the pixel PX may be driven in a first period P1, a second period P2, and a third period P3.

During the first period P1, the pixel PX is provided with the first scan signal GW having the high level, the second scan signal GI having the low level, and the emission control signal EM having the high level. The second switching element T2, the third switching element T3, and the seventh switching element T7 may turn off in response to the first scan signal GW having the high level. The fourth switching element T4 may turn on in response to the second scan signal GI having the low level. The first node N1 and the fourth node N4 may be coupled during the first period P1 because the fourth switching element T4 turns on. An initialization voltage VINIT may be provided to the first node N1 (i.e., the gate electrode of the first switching element T1) through the fourth switching element T4. The first node N1 may be initialized with the initialization voltage VINIT. The fifth switching element T5 and the sixth switching element T6 may turn off in response to the emission control signal EM having the high level.

During a portion of the second period P2, the pixel PX is provided with the first scan signal GW having the low level, the second scan signal GI having the high level, and the emission control signal EM having the high level. The second switching element T2, the third switching element T3, and the seventh switching element T7 may turn on in response to the first scan signal GW having the low level. The data voltage DATA may be provided to the second node N2 in the second period P2 because the second switching element T2 turns on. The third node N3 and the first node N1 may be coupled and the first switching element T1 may be diode-connected in the second period P2 because the third switching element T3 turns on. Thus, the data voltage DATA in which a threshold voltage of the first switching element T1 is compensated may be stored in the storage capacitor CST. The fourth node N4 and the fifth node N5 may be coupled in the second period P2 because the seventh switching element T7 turns on. The initialization voltage VINT may be provided to the fifth node N5 (i.e., the first electrode of the organic light emitting diode EL) through the seventh switching element T7. The fifth node N5 may be initialized with the initialization voltage VINIT. The fourth switching element T4 may turn off in response to the second scan signal GI having the high level and a connection node NC at which two switching elements T4-1, T4-2 are connected may be floating. When the second scan signal GI having the low level in the first period P1 is changed to the high level in the second period P2 (A), the first node N1 may be coupling with the second scan signal GI due to the parasitic capacitance. Thus, the voltage level of the first node N1 may increase. That is, the voltage level of the gate electrode of the first switching element T1 may increase greater than a voltage level of the initialization voltage VINIT because of leakage current occurring in the fourth switching element T4. The fifth switching element T5 and the sixth switching element T6 may turn off in response to the emission control signal EM having the high level.

During the third period P3, the pixel PX may be provided with the first scan signal GW having the high level, the second scan signal GI having the high level, and the emission control signal having the low level. The second switching element T2, the third switching element T3, and the seventh switching element T7 may turn off in response to the first scan signal GW having the high level. Here, a connection node NC at which two switching elements T3-1, T3-2 are connected may be floating. When the first scan signal GW having the low level in the second period P2 is changed to the high level in the third period P3 (B), the first node N1 may be coupling with the first scan signal GW due to the parasitic capacitance. Thus, the voltage level of the first node N1 may increase. That is, the voltage level of the gate electrode of the first switching element T1 may increase because of leakage current occurring in the third switching element T3. Thus, the voltage level of the first node N1 may increase because the voltage of the first node N1 increases in the second period P2 and in the third period P3. The fourth switching element T4 may turn off in response to the second scan signal GI having the high level. The fifth switching element T5 and the sixth switching element T6 may turn on in response to the emission control signal EM having the high level. The first power voltage ELVDD may be provided to the second node N2 because the fifth switching element T5 turns on. The first switching element T1 may generate the driving current corresponding to the voltage of the gate electrode (i.e., the first node N1). The third node N3 and the fifth node N5 may be coupled because the sixth switching element T6 turns on. The organic light emitting diode EL may emit light based on the driving current generated in the first switching element T1.

As described above, when the organic light emitting display device 200 that includes the pixel PX of FIG. 6A is driven in a low frequency driving method, the connection node of the third switching transistor T3 and the fourth transistor T4, that are each dual transistors, may be floating and the gate electrode of the first switching element T1 may be coupling with the first scan signal GW and the second scan signal GI. Thus, the voltage level of the gate electrode of the first switching element T1 may be changed. Thus, luminance of the pixel PX and the display panel 210 that includes the pixel PX may decrease.

Referring to FIG. 7, when the organic light emitting display device 200 is driven in the low frequency driving method, a luminance decreasing amount may be different according to a grayscale value (e.g., the grayscale value of image data). As shown in FIG. 7, the luminance decreasing amount in high-grayscale value image data may increase and the luminance decreasing amount in low-grayscale value image data may decrease. The organic light emitting display device 200 according to example embodiments may decrease the change in the amount of the voltage of the gate electrode of the first switching element T1 by controlling the voltage level of the first scan signal GW and the second scan signal GI based on grayscale value of the image data.

The timing controller 220 may receive first image data RGB1 and an input control signal CON from an external device. For example, in some embodiments, the first image data RGB1 may include red color image data, green color image data, and blue color image data. Further, in some embodiments, the first image data RGB1 may include magenta color image data, yellow color image data, and cyan color image data. The input control signal CON may include a master clock signal, a data enable signal, a vertical synchronization signal, a horizontal synchronization signal, etc. The timing controller 220 may generate second image data RGB2 based on the first image data RGB1. For example, the timing controller 220 may convert the first image data RGB1 to the second image data RGB2 by applying an algorithm that compensates display quality of the first image data RGB1. The timing controller 128 may output the second image data RGB2 to the data driver 240.

The timing controller 220 may generate a first control signal CTL1, a second control signal CTL2, and a third control signal CTL3 that control the scan driver 230, the data driver 240, and the emission controller 250 based on the first image data RGB1 and the input control signal CON. The timing controller 220 may generate the first control signal CTL1 based on the input control signal CON in order to control an operation of the scan driver 230. The timing controller 220 may output the first control signal CTL1 to the scan driver 230. For example, the first control signal CTL1 may include a vertical start signal and a scan clock signal. The timing controller 220 may generate the second control signal CTL2 based on the input control signal CON in order to control an operation of the data driver 240. The timing controller 220 may output the second control signal CTL2 to the data driver 240. For example, the second control signal CTL2 may include a horizontal start signal and a load signal. The timing controller 220 may generate the third control signal CTL3 based on the input control signal CON in order to control an operation of the emission controller 250. The timing controller 220 may output the third control signal CTL3 to the emission controller 250.

The timing controller 220 may output a first level control signal LCTL1 that controls a voltage level of the first scan signal GW and a second level control signal LCTL2 that controls a voltage level of the second scan signal GI. The timing controller 220 may generate the first level control signal LCTL1 and the second level control signal LCTL2 based on an average value of the grayscale values of the first image data RGB1. In some example embodiments, the timing controller 220 may calculate the average value of the grayscale values of the first image data RGB1 for each frame. In other example embodiments, the timing controller 220 may calculate the average value of the grayscale values of the first image data RGB1 provided to one of pixel lines. For example, the timing controller 220 may calculate an average value of the grayscale values of the first image data RGB1 provide to the pixels arranged in a horizontal direction.

The timing controller 220 may include a first lookup table (LUT) 222 that stores the first level control signal LCTL1 corresponding to the average value of the grayscale values of the first image data RGB1 and the second lookup table 224 that stores the second level control signal LCTL2 corresponding to the average value of the grayscale values of the second image data RGB2. The first lookup table 222 may store the first level control signal LCTL1 that controls the voltage level of the first scan signal GW, and the second lookup table 224 may store the second level control signal LCTL2 that controls the voltage level of the second scan signal GI. The timing controller 220 may output the first level control signal LCTL1 using the first lookup table 222 and output the second level control signal LCTL2 using the second lookup table 224. Alternatively, the timing controller 220 may output the first level control signal LCTL1 and the second level control signal LCTL2 corresponding to the average value of the grayscale values of the first image data RGB1 using the same lookup table. The first level control signal LCTL1 may be a signal that controls the voltage level of the first scan signal GW and the second level control signal LCTL2 may be a signal that controls the voltage level of the second scan signal GI. For example, the first level control signal LCTL1 and the second level control signal LCTL2 may be a gate on voltage or a gate off voltage in order to generate the first scan signal GW and the second scan signal GI. In some example embodiments, the first level control signal LCTL1 and the second level control signal LCTL2 may be the same signal. In other example embodiments, the first level control signal LCTL1 and the second level control signal LCTL2 may be different signals.

The scan driver 230 may generate the first scan signal GW and the second scan signal GI in response to the first control signal CTL2, the first level control signal LCTL1 and the second level control signal LCTL2. For example, the scan driver 230 may change a high level voltage of the first scan signal GW based on the first level control signal LCTL1 and may change a high level voltage of the second scan signal GI based on the second level control signal LCTL2. For example, the scan driver 230 may decrease the high level voltages of the first scan signal GW and the second scan signal GI based on the average value of the grayscale values of the first image data RGB1. Thus, an amount of coupling of the gate voltage of the first switching element T1 may decrease. For example, when the average value of the grayscale values of the first image data RGB1 is at a 255 grayscale value or 255 grayscale level (e.g., on a 0-255 grayscale scale), the scan driver 230 may output the first scan signal GW and the second scan signal GI having the high level voltage 3.0V, and when the average value of the grayscale values of the first image data RGB1 is at a 51 grayscale value, the scan driver 230 may output the first scan signal GW and the second scan signal GI having the high level voltage 3.3V. Here, the amount of the coupling of the gate voltage If the first switching element T1 may decease because the high level voltage of the first scan signal GW and the second scan signal GI of the 255 grayscale value is less than the high level voltage of the first scan signal GW and the second scan signal GI of the 51 grayscale value. Thus, a decreasing amount of luminance in the 255 grayscale value may decrease. Here, the high level voltage of the first scan signal GW and the second scan signal GI may be greater than a voltage level that turns off the first switching element T1 and the second switching element T2.

The data driver 240 may generate the data voltage based on the second image data RGB2 and the second control signal CTL2. The data driver 240 may generate the gamma reference voltage based on the second control signal CTL2 and the analog driving voltage. The gamma reference voltage may have a voltage level corresponding to the second image data RGB2. For example, the data driver 240 may generate the gamma reference voltage by dividing the analog driving voltage. The data driver 240 may convert the second image data RGB2 to the data voltage DATA that is an analog signal using the gamma reference voltage. The data driver 240 may output the data voltage DATA to the data line DL.

The emission controller 250 may generate the emission control signal EM in response to the third control signal CTL3. The emission controller 250 may output the emission control signal EM to the emission control lines EML.

As described above, the organic light emitting display device 200 according to example embodiments may control the voltage level of the first scan signal GW and the second scan signal GI based on the average value of the grayscale values of the image data. Thus, a changing amount of luminance of the organic light emitting display device 200 may decrease because the changing amount of the gate voltage of the first switching element in each of the grayscale decreases.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and features of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. An organic light emitting display device comprising:

a display panel comprising a plurality of pixels; and a panel driver configured to provide a first scan signal, a second scan signal, a data voltage, an initialization voltage, a first power voltage, and a second power voltage to the pixels, each of the pixels comprising:

a first switching element having a gate electrode coupled to a first node, a first electrode coupled to a second node, and a second electrode coupled to a third node;

a second switching element having a gate electrode to receive the first scan signal, a first electrode to receive the data voltage, and a second electrode coupled to the second node;

a third switching element having a gate electrode to receive the first scan signal, a first electrode coupled to the first node, and a second electrode coupled to the third node;

a fourth switching element having a gate electrode to receive the second scan signal, a first electrode coupled to the first node, and a second electrode to receive the initialization voltage;

a storage capacitor having a first electrode to receive the first power voltage and a second electrode coupled to the first node; and an organic light emitting diode having a first electrode to receive a driving current from the first switching element and a second electrode to receive the second power voltage, wherein the first switching element, the second switching element, and the third switching element are switching elements of a first type, and the fourth switching element is a switching element of a second type different from the first type, and wherein a voltage of the first node is changed by a first level according to a change in the second scan signal from a gate-on voltage to a gate-off voltage, the voltage of the first node is changed by a second level according to a change in the first scan signal from a gate-on voltage to a gate-off voltage, and the first level and the second level offset each other.

2. The organic light emitting display device of claim 1, wherein the switching element of the first type comprises a P-channel metal oxide semiconductor (PMOS) transistor, and the switching element of the second type comprises an N-channel metal oxide semiconductor (NMOS) transistor.

3. The organic light emitting display device of claim 1, wherein the switching element of the first type comprises an N-channel metal oxide semiconductor (NMOS) transistor, and the switching element of the second type comprises a P-channel metal oxide semiconductor (PMOS) transistor.

4. The organic light emitting display device of claim 1, wherein the panel driver is configured to drive the display panel in a frame, and wherein the frame comprises a first period during which a gate voltage of the gate electrode of the first switching element is initialized with the initialization voltage, a second period during which the data voltage is written, and a third period during which the organic light emitting diode emits light.

5. The organic light emitting display device of claim 4, wherein the second scan signal having a turn-on level is provided during the first period, the first scan signal having the turn-on level is provided during the second period, an emission control signal having the turn-on level is provided during the third period.

6. The organic light emitting display device of claim 1, wherein the third switching element and the fourth switching element are dual gate transistors.

7. The organic light emitting display device of claim 1, wherein the fourth switching element is a single gate transistor.

8. A pixel of an organic light emitting display device, the pixel comprising:

a first switching element having a gate electrode coupled to a first node, a first electrode coupled to a second node, and a second electrode coupled to a third node;

a second switching element having a gate electrode that receives a first scan signal, a first electrode that receives a data voltage, and a second electrode coupled to the second node;

a third switching element having a gate electrode to receive the first scan signal, a first electrode coupled to the first node, and a second electrode coupled to the third node;

a fourth switching element having a gate electrode to receive a second scan signal, a first electrode coupled to the first node, and a second electrode to receive an initialization voltage;

a storage capacitor having a first electrode to receive a first power voltage and a second electrode coupled to the first node; and an organic light emitting diode having a first electrode to receive a driving current provided by the first switching element and a second electrode to receive a second power voltage, wherein the first switching element, the second switching element, and the third switching element are switching elements of a first type, and the fourth switching element is a switching element of a second type different from the first type, and wherein a voltage of the first node is changed by a first level according to a change in the second scan signal from a gate-on voltage to a gate-off voltage, the voltage of the first node is changed by a second level according to a change in the first scan signal from a gate-on voltage to a gate-off voltage, and the first level and the second level offset each other.

9. The pixel of claim 8, wherein the switching element of the first type comprises a P-channel metal oxide semiconductor (PMOS) transistor, and the switching element of the second type comprises an N-channel metal oxide semiconductor (NMOS) transistor.

10. The pixel of claim 8, wherein the switching element of the first type comprises an N-channel metal oxide semiconductor (NMOS) transistor, and the switching element of the second type comprises a P-channel metal oxide semiconductor (PMOS) transistor.

11. The pixel of claim 8, wherein the third switching element and the fourth switching element comprise dual gate transistors.

12. The pixel of claim 8, wherein the fourth switching element comprises a single gate transistor.

13. An organic light emitting display device comprising:

a display panel comprising a plurality of pixels;

a data driver configured to generate a data voltage provided to the pixels;

a scan driver configured to generate a first scan signal and a second scan signal provided to the pixels;

an emission controller configured to generate an emission control signal provided to the pixels; and a timing controller configured to generate control signals that control the data driver, the scan driver, and the emission controller, wherein the timing controller is configured to receive image data to be displayed on the display panel, and to output a first level control signal that controls a voltage level of the first scan signal and a second level control signal that controls a voltage level of the second scan signal based on grayscale values of the image data, and wherein the timing controller is configured to generate the first level control signal and the second level control signal based on an average value of the grayscale values of the image data.

14. The organic light emitting display device of claim 13, wherein the timing controller is configured to generate the first level control signal and the second level control signal based on an average value of the grayscale values of the image data per frame.

15. The organic light emitting display device of claim 13, wherein the timing controller is configured to generate the first level control signal and the second level control signal based on an average value of the grayscale value of the image data provided to one of pixel lines.

16. The organic light emitting display device of claim 13, wherein each of the pixels comprises:

a first switching element having a gate electrode coupled to a first node, a first electrode coupled to a second node, and a second electrode coupled to a third node;

a second switching element having a gate electrode to receive the first scan signal, a first electrode to receive a data voltage, and a second electrode coupled to the second node;

a third switching element having a gate electrode to receive the first scan signal, a first electrode coupled to the first node, and a second electrode coupled to the third node;

a fourth switching element having a gate electrode to receive the second scan signal, a first electrode coupled to the first node, and a second electrode coupled to a fourth node;

a fifth switching element having a gate electrode to receive the emission control signal, a first electrode to receive a first power voltage, and a second electrode coupled to the second node;

a sixth switching element having a gate electrode to receive the emission control signal, a first electrode coupled to the third node, and a second electrode coupled to a fifth node;

a seventh switching element having a gate electrode to receive the first scan signal, a first electrode coupled to the fourth node, and a second electrode coupled to the fifth node;

a storage capacitor having a first electrode to receive a first power voltage and a second electrode coupled to the first node; and an organic light emitting diode having a first electrode coupled to the fifth node and a second electrode to receive a second power voltage.

17. The organic light emitting display device of claim 16, wherein the first switching element, the second switching element, the third switching element, the fourth switching element, the fifth switching element, the sixth switching element, and the seventh switching element are P-channel metal oxide semiconductor (PMOS) transistors.

18. The organic light emitting display device of claim 17, wherein the scan driver is configured to change a high level voltage of the first scan signal based on the first level control signal and to change a high level voltage of the second scan signal based on the second level control signal.

19. The organic light emitting display device of claim 13, wherein the timing controller comprises a first lookup table that stores the first level control signal corresponding to an average value of the grayscale values of the image data and a second lookup table that stores a second control signal corresponding to an average value of the grayscale values of the image data.

* * * * *